US005706673A

United States Patent [19]

Shin

[11] Patent Number: 5,706,673

[45] Date of Patent: Jan. 13, 1998

[54] FREEZING COMPARTMENT AIR FLOW SYSTEM OF REFRIGERATOR

[75] Inventor: Jun-Chul Shin, Incheon, Rep. of Korea

[73] Assignee: Daewoo Electronics Co., Ltd., Seoul, Rep. of Korea

[21] Appl. No.: 715,228

[22] Filed: Sep. 18, 1996

[30] Foreign Application Priority Data

Sep. 18, 1995 [KR] Rep. of Korea ..... 95-30494

[51] Int. Cl.[6] ..... F25D 19/00

[52] U.S. Cl. ..... 62/455; 62/447; 62/407

[58] Field of Search ..... 62/407–408, 441, 62/447, 453, 455

[56] References Cited

U.S. PATENT DOCUMENTS

| | | | |
|---|---|---|---|
| 4,241,589 | 12/1980 | Grimm et al. | 62/265 |
| 4,539,819 | 9/1985 | Alba et al. | 62/78 |
| 4,590,773 | 5/1986 | Hoshino et al. | 62/333 |
| 4,768,353 | 9/1988 | Bushser | 62/408 |
| 4,944,157 | 7/1990 | Jenkins et al. | 62/407 |
| 5,214,936 | 6/1993 | Lim et al. | 62/407 |
| 5,392,615 | 2/1995 | Lim | 62/414 |
| 5,433,086 | 7/1995 | Cho et al. | 62/455 |

FOREIGN PATENT DOCUMENTS

| | | | |
|---|---|---|---|
| 402272281 | 11/1990 | Japan | 62/455 |

*Primary Examiner*—William Doerrler

*Attorney, Agent, or Firm*—Beveridge, DeGrandi, Weilacher & Young LLP

[57] ABSTRACT

Disclosed is a refrigerator for uniformly cooling a freezing compartment through the use of outlets and a passageway at the inner portion of the base plate of the freezing compartment. The base plate is provided with an upper plate having a plurality of air outlets and a lower plate having a plurality of protrusions for supporting the upper plate. The lower plate is manufactured from an insulating material. A chilled air passageway for exhausting the chilled air from the freezing compartment is formed between the upper and lower plates. The chilled air generated by an evaporator flows into the freezing compartment through a main-inlet and sub-inlets formed at the rear wall of the freezing compartment, and is exhausted through a main air exhausting outlet and the sub-outlets formed in the base plate. The chilled air exhausted through the sub air exhausting outlets flows through the chilled air passageway, that is formed in the base plate and joins the chilled air from the main air exhausting outlet. By using suboutlets in the base plate to improve the out flow of the exhausted air, the freezing compartment is cooled uniformly and the cooling efficiency of the refrigerator is increased.

4 Claims, 2 Drawing Sheets

FREEZING COMPARTMENT AIR FLOW SYSTEM OF REFRIGERATOR

BACKGROUND OF THE INVENTION

1. Field of the Invention

The present invention relates to a chilled air flow system of a refrigerator, and more particularly to a chilled air flow system of a freezing compartment.

2. Description of the Prior Art

Generally, a refrigerator is an apparatus for storing various foodstuffs in either a frozen or a refrigerated condition to extend the freshness of the foodstuffs for a long time. Such a refrigerator includes two cooling sections, one of which is a direct cooling type. That is, an evaporator used in a refrigerating cycle is installed in a food storage space and a direct heat-exchange is effectively achieved. The other type of the cooling section is an indirect cooling type, that is, an evaporator is mounted in an air passage remote from the food storage space. The air is heat-exchanged by the evaporator, and then the heat-exchanged air is directed to the food storage space by a fan.

The above described refrigerator commonly is provided with a freezing compartment and a refrigerating compartment located below the freezing compartment. Further, the refrigerating compartment is provided with a separate space having a temperature different from that of the main refrigerating compartment. This separated compartment is called a "vegetable storage area" or a "chilled compartment" for storing meats, etc. In these spaces, the foodstuffs can be individually stored in accordance with the desired conditions. On the front face of both the freezing compartment and the refrigerating compartment, doors are installed so that foodstuffs can be placed in or removed from the freezing compartment and the refrigerating compartment.

In the above-described refrigerator, in order to store the foodstuffs with the desired conditions, that is, in order to maintain each compartment at a predetermined temperature, the heat-exchanged chilled air is conducted into the inner portion of each compartment by the fan. The chilled air exhausted from the compartments flows along the air passages.

The passages are disclosed in U.S. Pat. No. 4,704,874 (issued to Thomson, et al. on Nov. 10, 1987 entitled "Household refrigerator air flow system"), in U.S. Pat. No. 5,388,427 (issued to Sun G. Lee on Feb. 14, 1995 entitled "Refrigerator with kimchi compartment") and in U.S. Pat. No. 5,433,086 (issued to Cho, et al. on Jul. 18, 1995 and assigned to the assignee of the present invention, entitled "Refrigerator having independent temperature control of plural compartment").

FIG. 1 illustrates the conventional refrigerator disclosed in Thomson et al., Cho et al. and Lee. As shown in FIG. 1, the conventional refrigerator includes a freezer compartment 10, a refrigerating compartment 30 which is separated from freezing compartment 10 by a partition 20 and located below freezing compartment 10, an evaporator 40 installed between freezing compartment 10 and an outer wall for cooling the air and removing the humidity contained in the air to generate a chilled air, a fan 50 positioned above evaporator 40 for directing the chilled air into freezing compartment 10 and refrigerating compartment 30, a main air duct 60 formed between evaporator 40 and the outer wall for providing a passage for the chilled air conducted into refrigerating compartment 30 by fan 50, a first air duct 62 formed between freezing compartment 10 and partition 30 for conducting the exhausting chilled air from freezing compartment 10 to evaporator 40, a second air duct 64 formed between partition 20 and refrigerating compartment 30 for conducting the exhausting chilled air from refrigerator 30 to evaporator 40, and a third air duct 66, in which the chilled air having respectively flown along the first duct 62 and the second duct 64 is mixed, for providing a passage for the mixed chilled air to flow toward evaporator 40.

The chilled air generated by evaporator 40 is directed into freezing compartment 10 and refrigerating compartment 30 by fan 50, cools compartments 10 and 30, and then flows to first air duct 62 through a first chilled air outlet 12 formed at the bottom portion of freezing compartment 10. Meanwhile, the chilled air conducted into refrigerating compartment 30 cools refrigerating compartment 30 and flows to second air duct 64 through a second chilled air outlet 32 formed at the upper portion of refrigerating compartment 30. The chilled airs from first and second air ducts 62 and 64 are mixed at third air duct 66 and the chilled air flows into evaporator 40 to be cooled again by evaporator 40. At this time, the humidity contained in the chilled air is transformed into a layer of frost and attaches to evaporator 40. The layer of frost is transformed into water by a heater 68 installed in the third air duct 66, and then the water is exhausted through a water outlet 69 formed at the bottom portion of third air duct 68.

The structure of the freezing compartment and the refrigerating compartment of the refrigerator for circulating the chilled air will be described briefly with reference to FIG. 1 below.

In the above-described refrigerator, the chilled air generated by evaporator 40 is circulated in the inner portions of freezing compartment 10 and refrigerating compartment 30, first, second and third air ducts 62, 64 and 66, and evaporator 40 by fan 50 to cool freezing compartment 10 and refrigerating compartment 30. Particularly, when cooling freezing compartment 10, the chilled air is directed into freezing compartment 10 by fan 50 through a chilled air inlet 14 formed at the rear portion of the freezing compartment 10. After cooling the inner portion of freezing compartment 10, the chilled air is exhausted from freezing compartment 10 through first chilled air outlet 12. The exhausted air flows along first air duct 62 and third air duct 66 to evaporator 40 and cooled again by evaporator 40.

However, as shown in FIG. 1, since the chilled air directed into freezing compartment 10 is rapidly exhausted through first chilled air outlet 12, the cooling efficiency at a portion in freezing compartment 10, for example, the portion marked as "A" is lower than that at other portions in the freezing compartment 10.

SUMMARY OF THE INVENTION

Accordingly, it is an object of the present invention to provide a refrigerator having a chilled air circulating system by which a uniform cooling of the inner portion of a freezing compartment can be achieved.

To accomplish the object of the present invention, there is provided a refrigerator comprising:

- a freezing compartment provided with a base plate having a chilled air passageway for exhausting a chilled air;
- a refrigerating compartment positioned below the freezing compartment;
- a partition for separating the freezing compartment and the refrigerating compartment and for forming a first air outlet between the base plate and the partition for exhausting the chilled air from the freezing compartment and a second air outlet between the refrigerating compartment and the partition for exhausting the chilled air from the refrigerating compartment;

an evaporator installed between the freezing compartment and an outer wall for cooling air and removing humidity contained in the air to generate the chilled air; and a fan for directing the flow of the chilled air into the freezing compartment and the refrigerating compartment, wherein a main air duct for providing a passage for the chilled air directed by the fan to flow into the refrigerating compartment is formed between the evaporator and the outer wall, a first air duct, through which the chilled air exhausted from the freezing compartment flows to the evaporator, is formed between the freezing compartment and the partition, a second air duct, through which the chilled air exhausted from the refrigerating compartment flows to the evaporator, is formed between the partition and the refrigerating compartment, and a third air duct, in which the chilled air from the first and second air ducts is mixed, is formed between the first and second air ducts and the evaporator.

The freezing compartment is provided with a rear wall having a main-inlet for the inflow of the chilled air, a base plate for cooperating with the partition to form the first air duct and an upper wall for cooperating with the rear wall and the base plate to define the freezing compartment.

The main-inlet for the chilled air directed by the fan to flow is formed at the upper portion of the rear wall and a plurality of sub-inlets for flowing the chilled air are formed below the main-inlet. The chilled air generated by the evaporator is directed into the freezing compartment through the main-inlet and the sub-inlets by the fan. The first outlet is formed between the front end portion of the base plate and the partition in order to exhaust the chilled air from the freezing compartment. The first outlet is connected with the first air duct.

The base plate comprises an upper plate having a plurality of a third outlet formed therein, and a lower plate positioned below the upper plate and formed of an insulating material. A chilled air passageway is formed between the upper plate and the lower plate and connected to the first air duct. Accordingly, the chilled air exhausted through the third outlet flows along the inner portion of the first air duct to the evaporator.

The lower plate is provided with a plurality of protrusions on the upper portion thereof. The upper plate is supported by the protrusions and the lower plate and the upper plates are separated by the protrusions. Between the protrusions, the chilled air passageway for the chilled air exhausted from the third outlet formed on the upper plate to flow is provided. The chilled air passageway is connected with the first outlet.

The chilled air generated by the evaporator is circulated in the freezing compartment by the fan to cool the freezing compartment and is exhausted to the first air duct through the first outlet and the third outlet. The chilled air exhausted from the refrigerating compartment through the second outlet is mixed with the chilled air exhausted through the chilled air passageway formed between the upper plate and the lower plate, the first outlet, and the first air duct in the third air duct. The mixed air in the third air duct is cooled again by the evaporator. At this time, the humidity contained in the air is transformed into a layer of frost and attaches to the evaporator. The frost is transformed into water by a heater installed in the third air duct and is drained out through a water outlet.

In the refrigerator according to the present invention, the chilled air directed into the freezing compartment by the fan cools the inner portion of the freezing compartment uniformly to increase the cooling effect of the freezing compartment. Accordingly, an increase in the capacity of the evaporator, the fan, or etc. is not needed to improve the cooling effect of the freezing compartment.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

Hereinafter, the constituting elements and the operation principles of the refrigerator according to an embodiment of the present invention will be explained in more detail with reference to the accompanying drawings.

Figure 1:
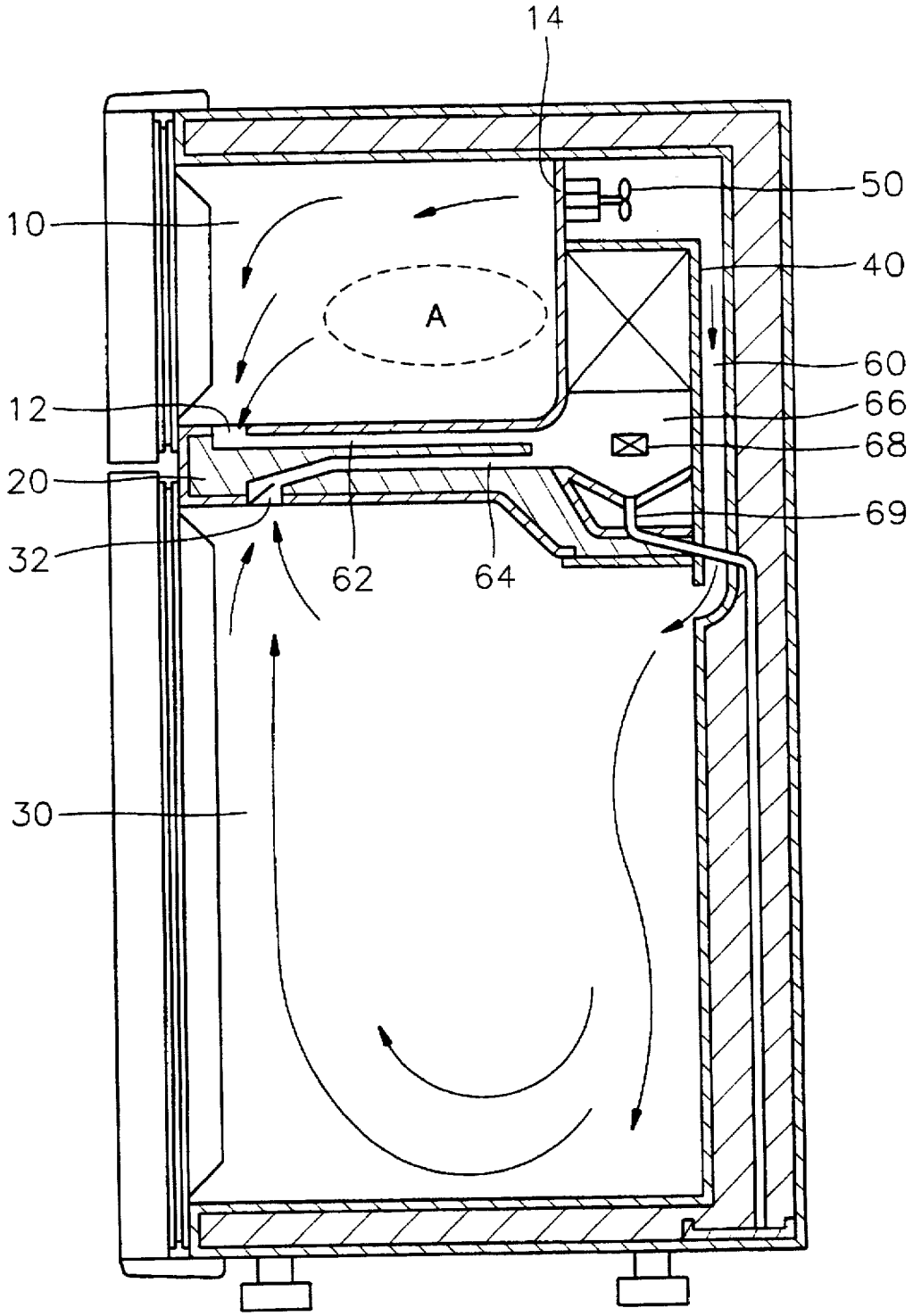
FIG. 1 (PRIOR ART)
FIG. 1 is a cross-sectional view of the conventional refrigerator, which shows a chilled air circulating system.
Figure 2:
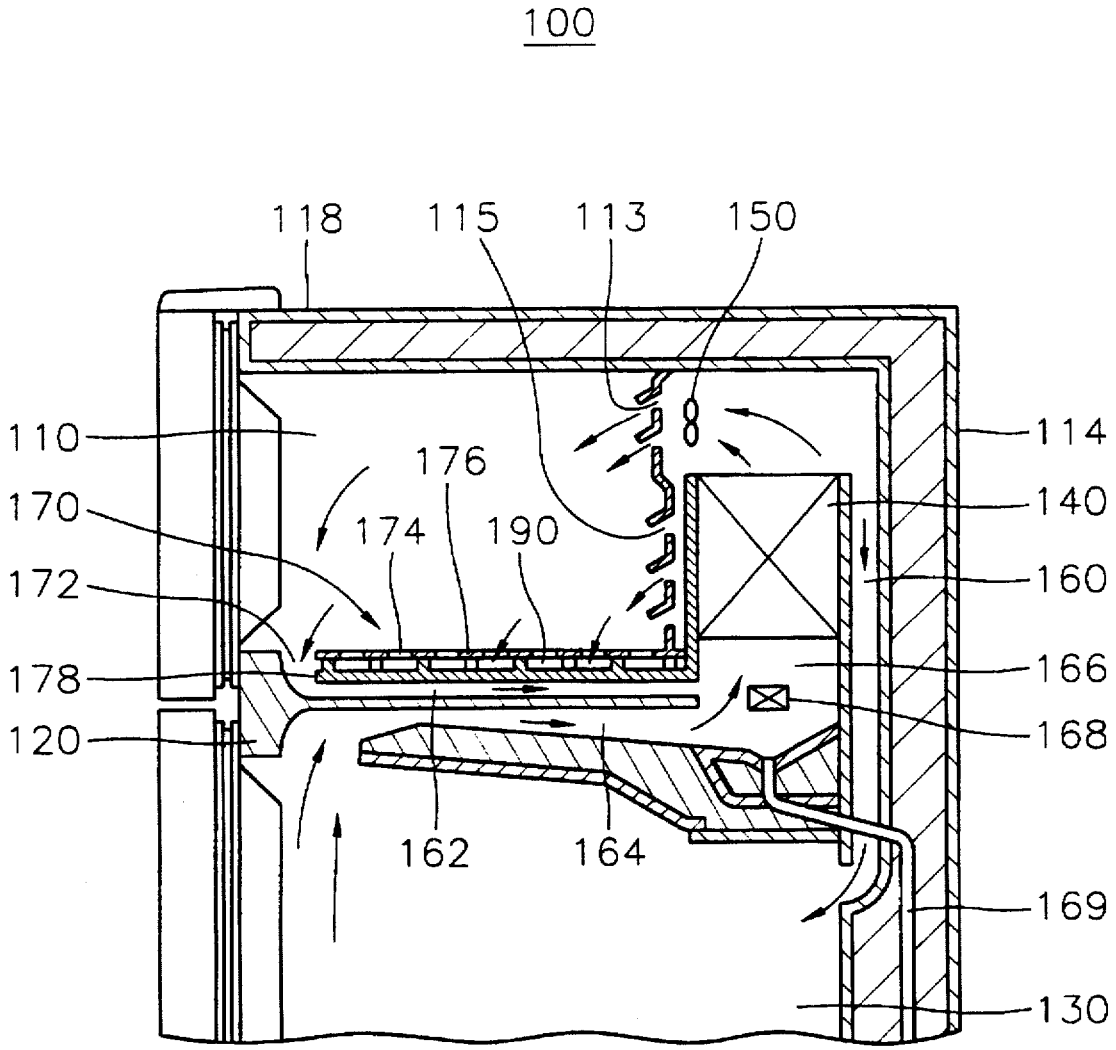
FIG. 2 is a cross-sectional view of a refrigerator according to the present invention, which shows a chilled air circulating system in a freezing compartment.

A refrigerator 100 according to a preferred embodiment of the present invention, as illustrated in FIG. 2, is provided with a freezing compartment 110, a refrigerating compartment 130 positioned below freezing compartment 110, a partition 120 for separating freezing compartment 110 and refrigerating compartment 130, an evaporator 140 for cooling air and removing the humidity contained in the air to generate a chilled air, a fan for directing the flow of the chilled air into freezing compartment 110 and refrigerating compartment 130, and a main air duct 160 for the chilled air to flow into refrigerating compartment 130.

Between the bottom surface of freezing compartment 110 and the upper surface of partition 120, a first air duct 162 for the exhausted air to flow from freezing compartment 110 is formed. And between the upper surface of refrigerating compartment 130 and the lower surface of partition 120, a second air duct 164 for the exhausted air to flow from refrigerating compartment 130 is formed. First and second air ducts 162 and 164 meet at a third air duct 166 which includes a water outlet 169 formed at the bottom portion thereof. A heater 168 is installed in third air duct 166 to remove frost from evaporator 140.

Evaporator 140 cools the air flowing through third air duct 166 again so that the humidity contained in the chilled air is removed from the chilled air. At this time, the humidity contained in the chilled air is transformed into frost and the frost attaches to evaporator 140. The frost is transformed into water by the heater 168 and removed. The water removed from evaporator 140 is drained through water outlet 169.

Freezing compartment 110 includes a rear wall 114 having a main-inlet 113 for the inflow of the chilled air, a base plate 170 for cooperating with partition 120 to form first air duct 162, and an upper wall 118 for cooperating with rear wall 114 and base plate 170 to define freezing compartment 110.

At the upper portion of rear wall 114, main-inlet 113, through which the chilled air is directed by fan 150, is formed and at the lower portion of main-inlet 113, a plurality of subinlets 115 smaller than main-inlet 113 are formed. The chilled air generated by evaporator 140 is directed into freezing compartment 110 through main-inlet 113 and sub-inlets 115 by fan 150.

A first outlet 172 is formed between the front end portion of base plate 170 and partition 120 to exhaust the chilled air from freezing compartment 110. First outlet 172 is connected with first air duct 162.

Base plate 170 is provided with an upper plate 176 having a plurality of third outlets 174, and a lower plate 178 manufactured with an insulating material and positioned below upper plate 176. A chilled air passageway 190, which is connected with first air duct 162, is formed between upper plate 176 and lower plate 178. Accordingly, the chilled air exhausted through third outlet 174 flows along first air duct 162 toward evaporator 140.

Lower plate 178 is provided with a plurality of supporting protrusions 179 formed at the upper surface thereof. Upper plate 176 is supported and is separated from lower plate 178 by supporting protrusions 179. Between supporting protrusions 179, chilled air passageway 190 for the chilled air exhausted from freezing compartment 110 through third outlet 174 formed at upper plate 176 to flow is formed. Chilled air passageway 190 is connected with first outlet 172.

The circulating process of the chilled air in refrigerator 110 according to a preferred embodiment of the present invention will be described in detail.

First, the chilled air generated by evaporator 140 is directed into freezing compartment 110 through main-inlet 113 and sub-inlets 115 by fan 150 installed at the upper portion of evaporator 140, and into refrigerating compartment 130 through main air duct 160.

The chilled air flowed into freezing compartment 110 circulates in the inner portion of freezing compartment 110 to cool the inner portion of freezing compartment 110, and then is exhausted from freezing compartment 110 through first outlet 172 and third outlet 174. The chilled air exhausted through third outlet 174 flows along chilled air passageway 190 formed between upper plate 176 and lower plate 178 of base plate 170, is mixed with the chilled air exhausted through first outlet 172, and flows along first air duct 162.

The chilled air flowing in first air duct 162 is mixed with the chilled air exhausted from refrigerating compartment 130 and flowing in second air duct 164, in third air duct 166. The mixed air is then directed toward evaporator 140. The chilled air mixed in third air duct 166 is cooled by evaporator 140 again. The humidity contained in the chilled air is transformed into frost and attaches to evaporator 140. The frost is transformed into water by heater 168. The water is drained off through water outlet 169.

As described above, the chilled air circulates through evaporator 140, fan 150, freezing compartment 110, first air duct 162, third air duct 166 and heater 168 to cool freezing compartment 110 uniformly.

While the preferred embodiment of the invention has been described, it is understood that the present invention should not be limited to this preferred embodiment, but various changes and modifications can be made by one skilled in the art within the spirit and scope of the invention as hereinafter claimed.

What is claimed is:

1. A refrigerator comprising:

a freezing compartment provided with a base plate having a chilled air passageway for exhausting a chilled air;

a refrigerating compartment positioned below said freezing compartment;

a partition for separating said freezing compartment and said refrigerating compartment and for forming a first air outlet between said base plate and said partition for exhausting said chilled air from said freezing compartment and a second air outlet between said refrigerating compartment and said partition for exhausting the chilled air from said refrigerating compartment, said base plate including an upper plate having a plurality of third outlets, and a lower plate having a plurality of protrusions for supporting said upper plate, and for forming said chilled air passageway with said upper plate;

an evaporator, which is installed between said freezing compartment and an outer wall, for cooling air and for removing humidity contained in the air to generate said chilled air; and a fan for directing the flow of said chilled air into said freezing compartment and said refrigerating compartment, wherein a main air duct for providing a passage for said chilled air to flow into said refrigerating compartment by said fan is formed between said evaporator and said outer wall, a first air duct for the flow of said chilled air exhausted from said freezing compartment to said evaporator is formed between said freezing compartment and said partition, a second air duct for flowing said chilled air exhausted from said refrigerating compartment to said evaporator is formed between said partition and said refrigerating compartment, and a third air duct where said chilled air from said first and second air ducts is mixed is formed between said first and second air ducts, and said evaporator.

2. A refrigerator as claimed in claim 1, wherein said freezing compartment further comprises:

a rear wall having a main-inlet for the inflow of said chilled air directed by said fan and a plurality of sub-inlets for said chilled air to flow, said sub-inlets being smaller than said main-inlet and being formed under said main-inlet; and an upper wall for cooperating with said rear wall and said base plate to define said freezing compartment, said base plate cooperating with said partition to form said first air duct.

3. A refrigerator as claimed in claim 1, wherein said lower plate is made from an insulating material.

4. A refrigerator comprising:

a freezing compartment provided with a base plate having a chilled air passageway for exhausting a chilled air, said freezing compartment including a rear wall having a main-inlet for said chilled air directed by a fan to flow and a plurality of sub-inlets for said chilled air to flow, said subinlets being smaller than said main-inlet and being formed under said main-inlet;

a refrigerating compartment positioned under said freezing compartment;

a partition for separating said freezing compartment and said refrigerating compartment and for forming a first air outlet between said base plate and said partition for exhausting said chilled air from said freezing compartment and a second air outlet between said refrigerating compartment and said partition for exhausting said chilled air from said refrigerating compartment, said base plate including an upper plate having a plurality of third outlets, and a lower plate having a plurality of protrusions for supporting said upper plate, and for forming said chilled air passageway with said upper plate, said lower plate being comprised of an insulating material;

an evaporator installed between said freezing compartment and an outer wall for cooling air and removing humidity contained in the air to generate said chilled air; and a fan for directing the flow of said chilled air into said freezing compartment and said refrigerating compartment, wherein a main air duct for providing a passage for said chilled air to flow into said refrigerating compartment by said fan is formed between said evaporator and said outer wall, a first air duct for the flow of said chilled air exhausted from said freezing compartment to said evaporator is formed between said freezing compartment and said partition, a second air duct for the flow of said chilled air exhausted from said refrigerating compartment to said evaporator is formed between said partition and said refrigerating compartment, and a third air duct where said chilled air from said first and second air ducts is mixed is formed between said first and second air ducts, and said evaporator.

* * * * *